US007707850B2

(12) United States Patent
Wang et al.

(10) Patent No.: US 7,707,850 B2
(45) Date of Patent: May 4, 2010

(54) DRAINAGE MECHANISM FOR A FLOODED EVAPORATOR

(75) Inventors: Jun Wang, Clarksville, TN (US); Mahesh Valiya Naduvath, Lutherville, MD (US); John F. Judge, Galena, OH (US)

(73) Assignee: Johnson Controls Technology Company, Holland, MI (US)

( * ) Notice: Subject to any disclaimer, the term of this patent is extended or adjusted under 35 U.S.C. 154(b) by 305 days.

(21) Appl. No.: 11/759,608

(22) Filed: Jun. 7, 2007

(65) Prior Publication Data

US 2008/0302130 A1 Dec. 11, 2008

(51) Int. Cl.
*F25B 43/00* (2006.01)

(52) U.S. Cl. ..... 62/512; 62/515; 55/320; 55/337; 55/462; 55/464

(58) Field of Classification Search ..... 62/512, 62/515, 519, 524; 55/320, 337, 428, 434, 55/447, 462, 464, 525, 421, 434.2, 434.3, 55/434.4, 467, 467.1; 165/110, 114, 160
See application file for complete search history.

(56) References Cited

U.S. PATENT DOCUMENTS

| | | | | | |
|---|---|---|---|---|---|
| 3,022,859 | A | * | 2/1962 | Sexton | 55/524 |
| 3,180,567 | A | | 4/1965 | Quiggle et al. | |
| 4,182,136 | A | | 1/1980 | Morse | |
| 4,671,082 | A | | 6/1987 | Maeda et al. | |
| 4,829,786 | A | | 5/1989 | Sand et al. | |
| 5,055,010 | A | | 10/1991 | Logan | |
| 5,561,987 | A | * | 10/1996 | Hartfield et al. | 165/117 |
| 5,588,596 | A | | 12/1996 | Hartfield et al. | |
| 5,645,124 | A | | 7/1997 | Hartfield et al. | |
| 5,829,265 | A | | 11/1998 | Lord et al. | |
| 5,868,001 | A | | 2/1999 | Shoulders | |
| 5,904,053 | A | | 5/1999 | Polk et al. | |
| 6,263,694 | B1 | | 7/2001 | Boyko | |
| 6,293,112 | B1 | | 9/2001 | Moeykens et al. | |
| 6,430,958 | B1 | | 8/2002 | Corrigan et al. | |
| 6,516,627 | B2 | | 2/2003 | Ring et al. | |
| 6,532,763 | B1 | * | 3/2003 | Gupte | 55/434.4 |
| 6,655,173 | B2 | | 12/2003 | Iritani et al. | |
| 2005/0217838 | A1 | | 10/2005 | Katoh et al. | |

* cited by examiner

*Primary Examiner*—Frantz F Jules
*Assistant Examiner*—Daniel C Comings
(74) *Attorney, Agent, or Firm*—McNees Wallace & Nurick, LLC

(57) ABSTRACT

A liquid refrigerant drainage mechanism is described for use in a flooded evaporator to mitigate liquid carryover. The drainage mechanism can trap liquid refrigerant droplets, create a liquid column to overcome a pressure difference across the mechanism and drain liquid back to the pool in the evaporator. The drainage mechanism is disposed in a suction baffle, and has a mesh pad and a tapered pipe secured to the bottom of the baffle. The pipe has a drainage aperture at one end to allow the accumulated liquid refrigerant to return to the refrigerant pool below. The mesh pad helps to separate liquid droplets that coalesce and fall into the tapered pipe. By using this liquid drainage mechanism in conjunction with a suction baffle, liquid carryover can be reduced and chiller performance improved.

21 Claims, 6 Drawing Sheets

DRAINAGE MECHANISM FOR A FLOODED EVAPORATOR

BACKGROUND

The present application is directed generally to an evaporator arrangement. Specifically, the present application is directed to a liquid collection and drainage system to remove liquid refrigerant from vapor refrigerant in an evaporator.

In a refrigeration circuit, refrigerant vapor passes from the evaporator to the compressor. If the refrigerant isn't completely changed to vapor in the evaporator, some liquid refrigerant may be passed on to the compressor as liquid carryover. This liquid carryover can affect both the performance and the life of the compressor.

For example, in a flooded evaporator that has liquid refrigerant introduced in the lower part of the evaporator shell to exchange heat with a fluid passing through a tube bank, liquid droplets may be entrained in the refrigerant vapor flow leaving the evaporator after exchanging heat with the fluid within the tube bank. One approach to solving this problem is to provide a liquid/vapor separator, either internally or externally of the evaporator. While these separators are effective, they add substantial expense to the system.

Another approach to removing liquid refrigerant from the refrigerant vapor in the evaporator has been to provide sufficient vertical space between the top of the tube bank and the suction nozzle at the top of the evaporator shell such that any liquid droplets will be caused to flow downwardly by the force of gravity before they reach the suction nozzle. This approach requires the use of a larger shell, which is costly because of the added materials and space that it requires.

Yet another approach for removing liquid refrigerant has been to provide a so-called "mist eliminator" in the form of a wire mesh, between the top of the tube bank and the compressor suction. Such an eliminator tends to interrupt the flow of the liquid droplets, allowing them to collect on the eliminator and to eventually fall by force of gravity. This approach is somewhat effective in controlling liquid carryover and while it requires less space then the approach described hereinabove, it does require some additional space for the eliminator and also involves additional cost. In addition, the eliminator is recognized as being a passive system in the sense that it simply turns back the droplets, which will tend to be entrained in the flow of refrigerant vapor as before. Furthermore, the eliminator causes pressure drop of the vapor flow resulting in degradation of the performance of the chiller.

Other approaches for removing liquid refrigerant include providing a baffle above the tube banks for interrupting and collecting the upward flow of liquid refrigerant droplets that would otherwise tend to flow to the compressor along with the refrigerant vapor. Heat may be added to the baffle to cause an evaporation of the liquid droplets such that the resulting vapor passes to the compressor. However, this approach does not offer an effective drainage of the liquid collected by the baffle.

Intended advantages of the methods and/or systems satisfy one or more of the needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment is directed to a liquid collection and drainage system to remove liquid refrigerant from refrigerant vapor in an evaporator including a baffle having an inside surface to be disposed adjacent a suction inlet of the evaporator and an outside surface to be disposed adjacent a refrigerant pool of the evaporator. The system also includes a mesh pad and a drainage pipe. The mesh pad is disposed adjacent to the inside surface of the baffle and is configured to trap liquid refrigerant. The drainage pipe has a drain hole at one end and is configured to extend along the baffle to permit liquid refrigerant to flow to the drain hole. Liquid refrigerant is trapped by the mesh pad and collected in the drainage pipe to flow to the drain hole for return to a refrigerant pool.

Another embodiment is directed to an evaporator with a drainage system to remove liquid refrigerant from refrigerant vapor including a housing having an upper portion and a lower portion, a tube bank disposed in the lower portion of the housing and a drainage device disposed in the upper portion of the housing. The drainage device includes a suction baffle having an inside surface to be disposed adjacent a suction inlet of the evaporator and an outside surface to be disposed adjacent the tube bank. The drainage device also includes a mesh pad configured and disposed adjacent the inside surface of the suction baffle to trap liquid refrigerant. Further, the drainage device has a tapered pipe configured with a drain hole at one end and extending along the bottom of the suction baffle. Liquid refrigerant is trapped by the mesh pad and flows into the tapered pipe upon operation, where the trapped liquid refrigerant builds a liquid column and flows toward the drain hole.

One advantage is the reduction in liquid carryover into the compressor.

Another advantage is decreased power consumption and higher system efficiency compared to a system with liquid carryover.

Another advantage is the elimination of costly and large devices or systems to remove the liquid carryover.

Alternative exemplary embodiments relate to other features and combinations of features as may be generally recited in the claims.

DETAILED DESCRIPTION

Figure 1:
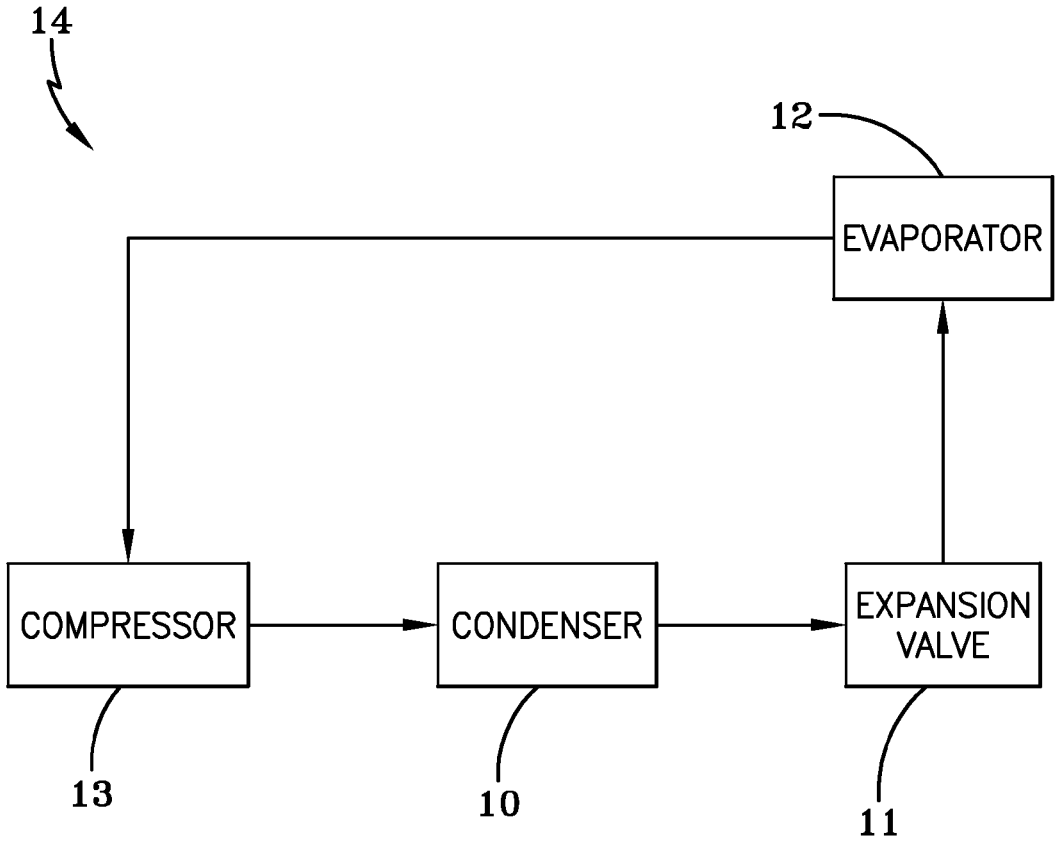
FIG-1 Prior Art
FIG. 1 illustrates schematically a refrigeration system.

FIG. 1 is a schematic diagram of a refrigeration system 14. Refrigeration system 14 includes a compressor 13, a condenser 10, an evaporator 12 and an expansion device 11. Compressor 13 compresses a refrigerant vapor and delivers the vapor to condenser 10. Compressor 13 can be a centrifugal compressor, scroll compressor, rotary compressor, screw compressor, swing link compressor, turbine compressor, or any other suitable compressor. The refrigerant vapor delivered by compressor 13 to condenser 10 enters into a heat exchange relationship with a fluid, e.g., air or water, and undergoes a phase change to a refrigerant liquid as a result of the heat exchange relationship with the fluid. The condensed liquid refrigerant from condenser 10 flows through an expansion device 11 to evaporator 12.

The condensed liquid refrigerant delivered to evaporator 12 enters into a heat exchange relationship with a fluid, e.g., water, brine or ethylene glycol, and undergoes a phase change to a refrigerant vapor as a result of the heat exchange relationship with the fluid. The vapor refrigerant in evaporator 12 exits evaporator 12 and returns to compressor 13 by a suction line to complete the cycle. It is to be understood that any suitable configuration of condenser 10 can be used in system 14, provided that the appropriate phase change of the refrigerant in condenser 10 is obtained. Refrigeration system 14 can include many other features that are not shown in FIG. 1.

Figure 2:
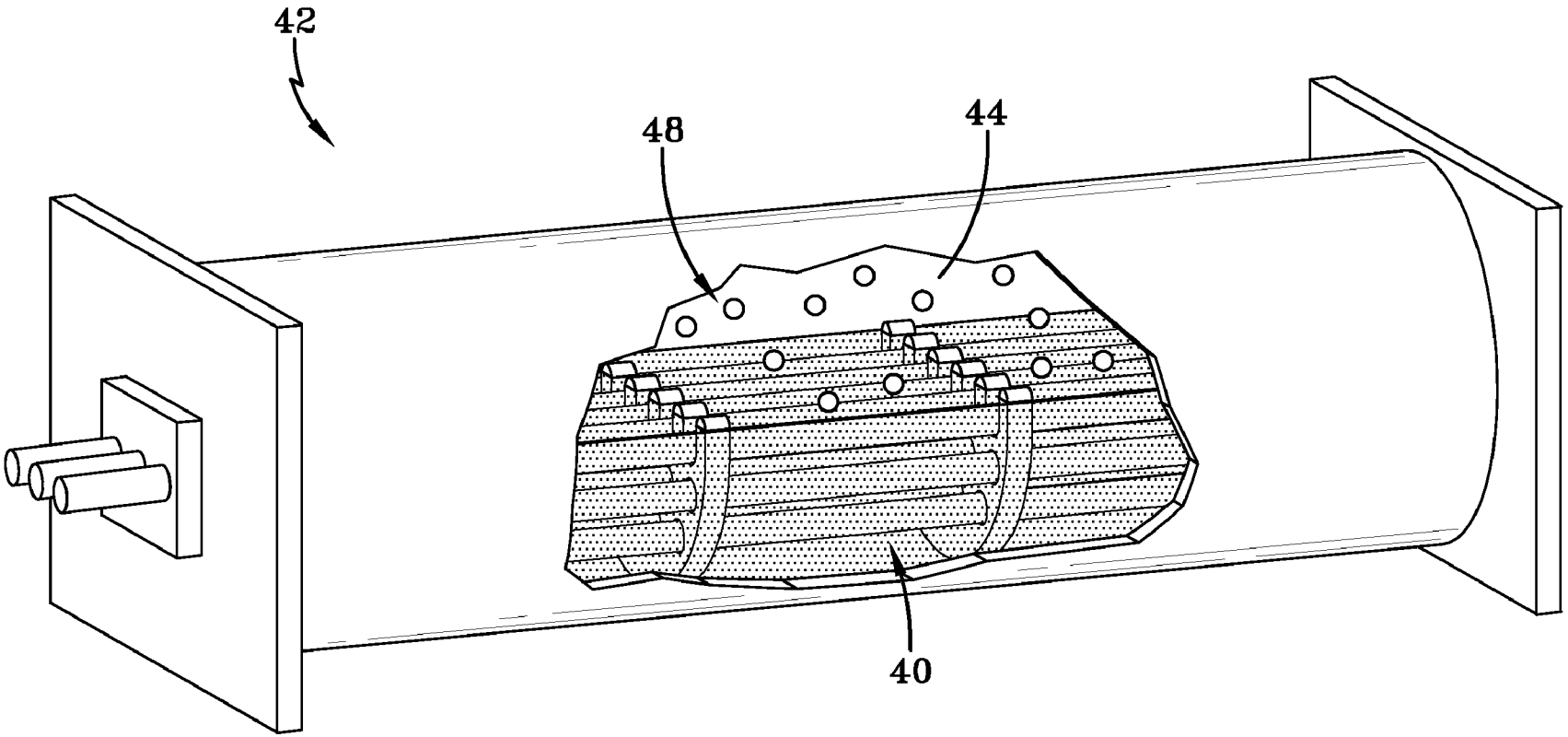
FIG-2 PRIOR ART
FIG. 2 illustrates a conventional flooded evaporator system.

Now referring to FIG. 2, a side view of a prior art flooded evaporator 42 system with a refrigerant pool 40 at the bottom of evaporator 42. Upper portion 44 of the system has no drainage device, and is an empty cavity where the refrigerant vapor with entrained liquid 48 exits evaporator 42 through a suction connection. In a conventional system as shown in FIG. 2, the pool of liquid refrigerant 40 absorbs the heat from the tubes carrying the fluid into and out of the evaporator, and undergoes a phase change from liquid to vapor. In flooded evaporator 42, the liquid refrigerant droplets may travel through the suction line (not shown) causing damaging effects on the compressor and refrigerant system.

Figure 3:
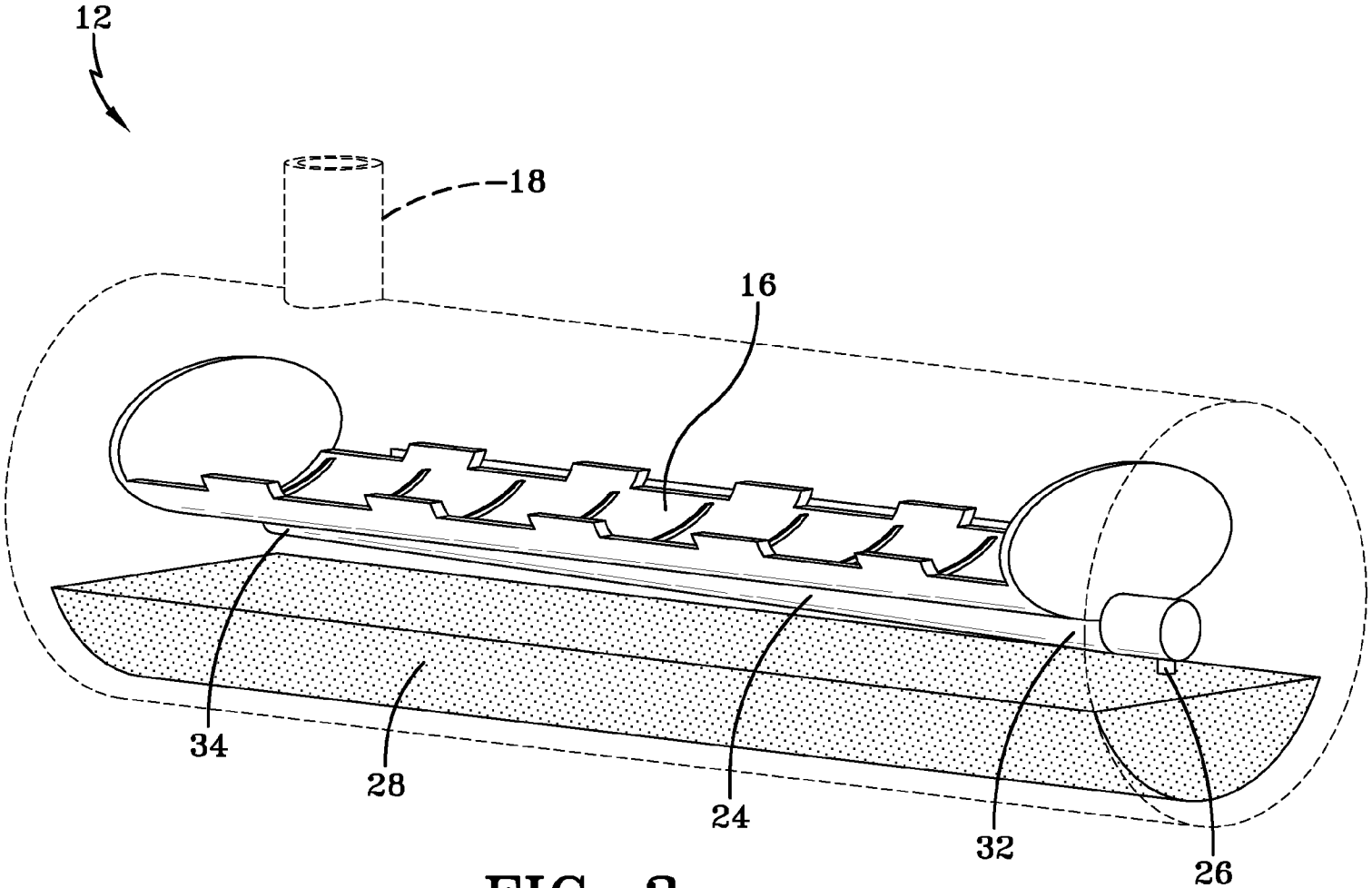
FIG. 3 illustrates a perspective view of one embodiment of a flooded evaporator.
Figure 4:
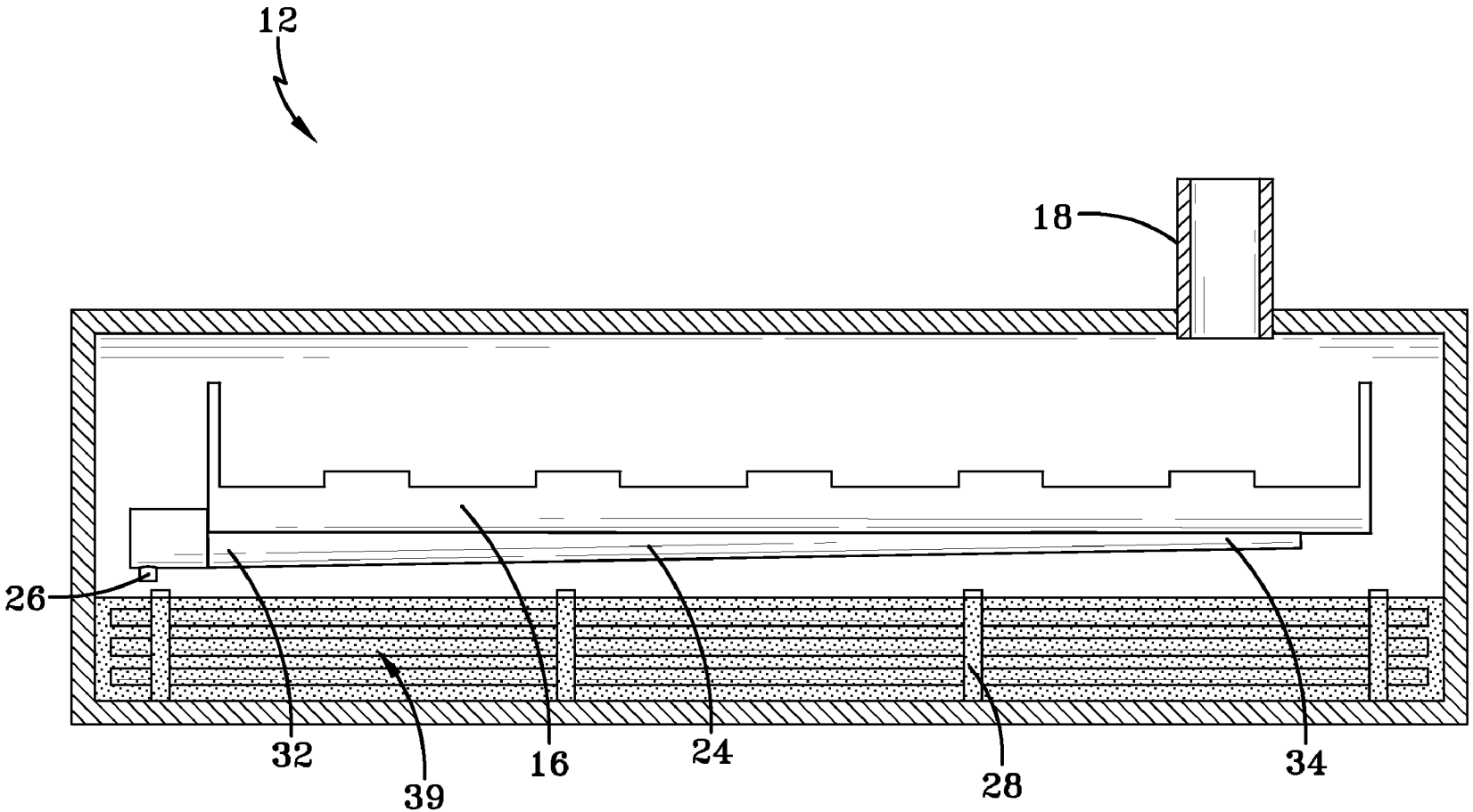
FIG. 4 illustrates a side view of the flooded evaporator of FIG. 3.
Figure 6:
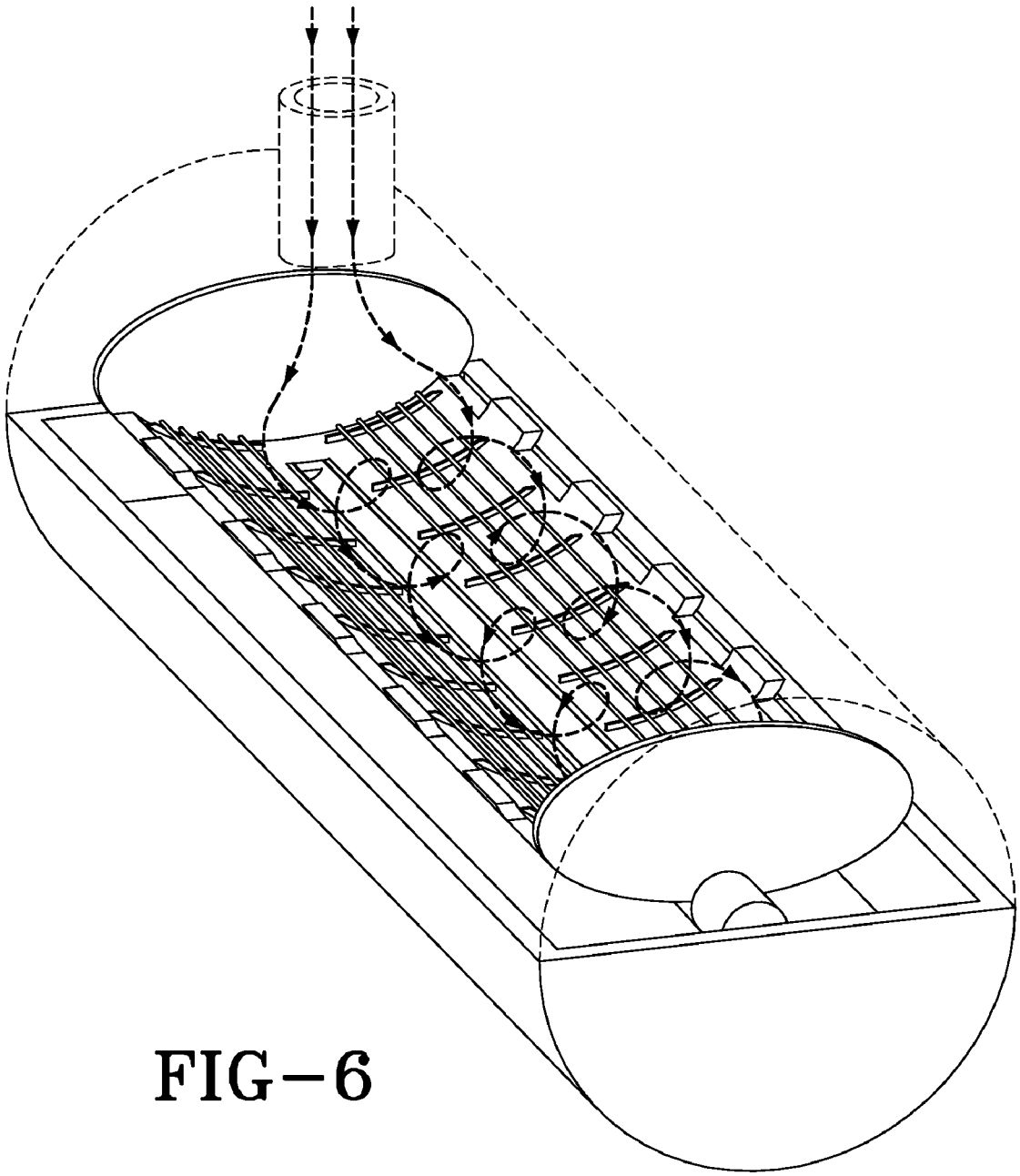
FIG. 6 illustrates the swirling flow of the refrigerant vapor in the flooded evaporator of FIG. 5.

Referring now to FIGS. 3 and 4, suction baffle 16 is located inside of the upper portion of flooded evaporator 12. The refrigerant vapor flows around baffle 16 and is eventually returned to compressor 13 through compressor suction piping 18. In an effort to prevent any liquid from entering into compressor 13 and compressor suction piping 18, suction baffle 16 is used to impart a swirling flow to the refrigerant vapor as it flows around suction baffle 16 to exit flooded evaporator 12. As illustrated in FIG. 6, the swirling flow is induced by the entry of the refrigerant vapor containing liquid droplets through the slots in the suction baffle and assists in the separation process between the refrigerant vapor and any refrigerant liquid that is carried with the vapor. The swirling flow causes the refrigerant liquid to collide and form larger droplets that eventually collide with mesh pad 22 that is attached to or placed on the inside wall of suction baffle 16 or that fall by gravity into mesh pad 22. The collected refrigerant liquid collects at the bottom of baffle 16 where a tapered pipe 24 is located. The collected liquid continues to collect in tapered pipe 24 until a column of liquid is formed in pipe 24. The column of liquid is sized such that it eventually overcomes the pressure difference between the two sides of suction baffle 16 and drains through drain hole 26 into refrigerant pool 28 below, which includes tube bundle 39 (shown only in FIG. 4).

Mesh pad 22 is a thin layer of steel, plastic, or other material suitable for absorbing refrigerant liquid that is separated from the refrigerant vapor by suction baffle 16. Mesh pad 22 is secured in baffle 16 by use of retainers such as clips, rods and other suitable fasteners. In addition, suction baffle 16 may have a grooved surface that is also constructed of any material suitable for collecting liquid refrigerant. The grooves may be formed by manufacturing them with the baffle as one unitary piece. The grooves on the surface of suction baffle 16 are protrusions that allow any liquid in the vapor to collect. As the liquid droplets collect on the grooves and form droplets, the droplets follow the path of the grooves to the bottom of the baffle where the droplets fall into tapered pipe 24. The protrusions of the grooves form a path extending downward to tapered pipe 24 so that the droplets collected thereon can flow easily to pipe 24 and on to drain hole 26.

Figure 5:
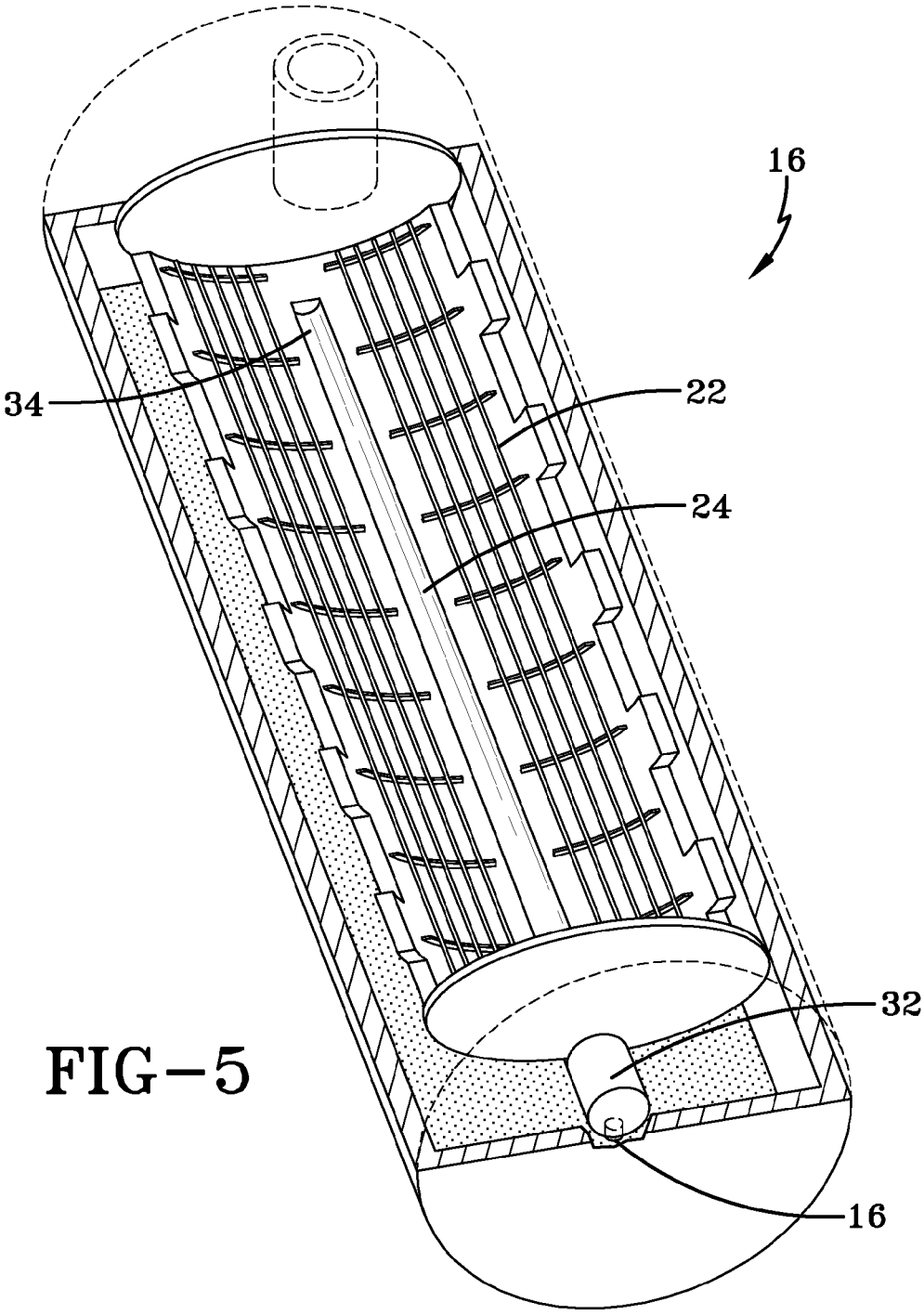
FIG. 5 illustrates a perspective view of another embodiment of a flooded evaporator.

Tapered pipe 24 is shaped such that it is sized from a larger diameter end 32 to a smaller diameter end 34 as shown in FIG. 5. Smaller diameter end 34 is closed off with no outlet, to ensure that all of the collected drainage exits at larger diameter end 32 of tapered pipe 24. A drain hole 26 is located at larger diameter end 32 and allows the collected refrigerant to drain from pipe 24 into refrigerant liquid pool 28 below baffle 16 and in the bottom of evaporator 12. Tapered pipe 24 can be a separate unit that is disposed at the bottom of suction baffle 16, or it can be a unitary unit or integral with suction baffle 16. A weld connection or other similar suitable connection can be used to secure the tapered pipe 24 in the suction baffle 16. In addition to being tapered in shape with a larger diameter end 32 and a smaller diameter end 34, tapered pipe 24 can also be disposed in suction baffle 16 at a slant or angle, to help with diverting the collected liquid to larger diameter end 32 and drain hole 26. Tapered pipe 24 is angled such that smaller diameter end 34 is at a higher level than larger diameter end 32 such that the collected liquid tends to flow downward toward drain hole 26. Alternately, tapered pipe 24 may not have a drain hole 26 and may connect directly to a drainpipe at larger diameter end 32 to drain the collected liquid.

It should be understood that the application is not limited to the details or methodology set forth in the description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the drainage mechanism as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

What is claimed is:

1. A liquid collection and drainage system to remove liquid refrigerant from refrigerant vapor in an evaporator, the liquid collection and drainage system comprising:

a baffle having an inside surface to be disposed adjacent a suction inlet of the evaporator and an outside surface to be disposed adjacent a refrigerant pool of the evaporator, the baffle having a first edge and a second edge and a single curved profile extending from the first edge to the second edge, the single curved profile being concaved upward;

a mesh pad, the mesh pad being disposed on the inside surface of the baffle and configured to trap liquid refrigerant;

a drainage pipe having a drain hole at one end and being configured to extend along the baffle to permit liquid refrigerant to flow to the drain hole; and wherein liquid refrigerant is trapped by the mesh pad and collected in the drainage pipe to flow to the drain hole for return to the refrigerant pool.

2. The system of claim 1 wherein the baffle is configured to impart a swirling flow to the refrigerant to separate liquid refrigerant from vapor refrigerant.

3. The system of claim 1 further comprising at least one additional baffle extending substantially perpendicularly from the baffle.

4. The system of claim 1 wherein the baffle has a plurality of channels for the passage of refrigerant disposed at ends of the substantially curved shape of the baffle.

5. The system of claim 1 wherein the baffle has a grooved inside surface.

6. The system of claim 5 wherein the grooved inside surface comprises projections.

7. The system of claim 1 wherein the drainage pipe collects the trapped refrigerant liquid and builds a liquid column that overcomes a pressure difference between the inside surface and outside surface of the baffle to permit flow of liquid refrigerant.

8. The system of claim 1 wherein the mesh pad and the inside surface of the baffle are integrated as one unitary device.

9. The system of claim 1 wherein the drainage pipe and the outside surface are integrated as one unitary device.

10. The system of claim 1 wherein the drainage pipe is tapered and has a first end and a second end, wherein the second end has a larger diameter than the first end.

11. The system of claim 10 wherein the drain hole is disposed at a bottom of the drainage pipe at the second end.

12. An evaporator with a drainage system to remove liquid refrigerant from refrigerant vapor, the evaporator comprising:

a housing having an upper portion and a lower portion;

a tube bank, the tube bank being disposed in the lower portion of the housing;

a drainage device disposed in the upper portion of the housing, the drainage device comprising:

a suction baffle having an inside surface to be disposed adjacent a suction inlet of the evaporator and an outside surface to be disposed adjacent the tube bank, the suction baffle having a first edge and a second edge and a single elliptical profile extending from the first edge to the second edge, the single elliptical profile being concaved upward;

a mesh pad, the mesh pad being configured and disposed adjacent the inside surface of the suction baffle to trap liquid refrigerant;

a tapered pipe having a drain hole at one end and being configured to extend along the suction baffle; and wherein liquid refrigerant is trapped by the mesh pad and flows into the tapered pipe upon operation, wherein the trapped liquid refrigerant builds a liquid column and flows toward the drain hole.

13. The evaporator of claim 12 wherein the baffle is configured to impart a swirling flow to the refrigerant to separate the liquid refrigerant from vapor refrigerant.

14. The evaporator of claim 12 further comprising at least one additional baffle extending substantially perpendicularly from the suction baffle.

15. The evaporator of claim 12 wherein the suction baffle has a plurality of channels at the ends of the substantially elliptical shape of the baffle for passage of refrigerant.

16. The evaporator of claim 12 wherein the suction baffle comprises a grooved surface.

17. The evaporator of claim 12 wherein the tapered pipe collects the trapped refrigerant liquid and builds a liquid column that overcomes a pressure difference between the inside surface and outside surface of the suction baffle to permit flow of liquid refrigerant toward the drain hole.

18. The evaporator of claim 17 wherein the mesh pad and the inside surface of the suction baffle are integrated as one unitary device.

19. The evaporator of claim 17 wherein the drainage pipe and the suction baffle are integrated as one unitary device.

20. The evaporator of claim 14 wherein the tapered pipe has a first end and a second end, wherein the second end is larger than the first end.

21. The evaporator of claim 20 wherein the drain hole is disposed on the bottom of the tapered pipe at the second end.

* * * * *